US009140244B2

(12) United States Patent
Henderson

(10) Patent No.: US 9,140,244 B2
(45) Date of Patent: Sep. 22, 2015

(54) PISTON PUMP WITH CAM ACTUATED VALVES

(75) Inventor: Russell Henderson, Havana, IL (US)

(73) Assignee: Caterpillar Inc., Peoria, IL (US)

( * ) Notice: Subject to any disclaimer, the term of this patent is extended or adjusted under 35 U.S.C. 154(b) by 1057 days.

(21) Appl. No.: 13/222,103

(22) Filed: Aug. 31, 2011

(65) Prior Publication Data

US 2013/0052041 A1 Feb. 28, 2013

(51) Int. Cl.

| | |
|---|---|
| ***F04B 1/30*** | (2006.01) |
| ***F04B 1/20*** | (2006.01) |
| ***F04B 7/00*** | (2006.01) |
| ***F04B 1/32*** | (2006.01) |

(52) U.S. Cl.

CPC ..... *F04B 1/2042* (2013.01); *F04B 1/2035* (2013.01); *F04B 1/32* (2013.01); *F04B 7/008* (2013.01); *F04B 7/0057* (2013.01)

(58) Field of Classification Search

CPC ..... F02B 7/0291; F02B 7/008; F02B 7/0057; F02B 7/08; F02B 7/0839; F02B 1/2042; F02B 1/0057; F02B 1/2035; F02B 1/32; F02B 1/122; F02B 1/12; F02B 1/34; F02B 1/20; F02B 27/08; F02B 27/0839

USPC ..... 92/12.2, 71

See application file for complete search history.

(56) References Cited

U.S. PATENT DOCUMENTS

| | | | | |
|---|---|---|---|---|
| 2,315,076 | A * | 3/1943 | Orshansky, Jr. et al. | 91/473 |
| 3,956,969 | A | 5/1976 | Hein | |
| 4,092,905 | A | 6/1978 | Wood | |
| 4,576,554 | A | 3/1986 | Wagenseil et al. | |
| 4,745,748 | A * | 5/1988 | Hayashi et al. | 60/489 |
| 5,634,776 | A | 6/1997 | Leemhuis et al. | |
| 5,941,156 | A * | 8/1999 | Nagatomo | 91/482 |
| 6,406,271 | B1 | 6/2002 | Valentin | |
| 6,640,687 | B1 | 11/2003 | Frantz et al. | |
| 2005/0063834 | A1 | 3/2005 | Esders | |

FOREIGN PATENT DOCUMENTS

| | | |
|---|---|---|
| WO | 2008109901 | 9/2008 |

* cited by examiner

*Primary Examiner* — Devon Kramer
*Assistant Examiner* — Nathan Zollinger
(74) *Attorney, Agent, or Firm* — Uchendu Anyaso; Finnegan, Henderson, Farabow, Garrett & Dunner, LLP

(57) ABSTRACT

A method of controlling a piston pump is disclosed. The method includes actuating a plurality of pistons housed within a cylinder barrel to cause each of the plurality of pistons to engage in reciprocating motion. Fluid supplied to each of the pistons may be regulated by changing a clock position of an intake cam ring to cause a plurality of intake valves to open and close relative to the clock position of the intake cam ring. Fluid discharged by each of the pistons may be regulated by changing a clock position of an exhaust cam ring to cause a plurality of exhaust valves to open and close relative the clock position of the exhaust cam ring.

7 Claims, 4 Drawing Sheets

PISTON PUMP WITH CAM ACTUATED VALVES

TECHNICAL FIELD

The present disclosure relates generally to a piston pump, and more particularly, to a piston pump for use in a hydraulic system.

BACKGROUND

Piston pumps can generate a significant amount of noise during conventional modes of operation. Increasingly stringent regulations that are designed to limit overall noise in the workplace have created a demand for piston pumps that operate at lower sound levels.

There are a number of ways by which piston pumps generate noise. For example, when piston pumps operate, rotating pistons draw in hydraulic fluid through an inlet slot, typically at atmospheric pressure. After the pumping chamber is closed to the inlet, the piston passes bottom dead center (BDC). As the piston moves back to top dead center, it pressurizes and discharges the fluid into the outlet. As the fluid in the pumping chamber is pressurized during the transition just after BDC, the hydraulic fluid reaches a particular chamber pressure, after which it is discharged through the outlet and into a hydraulic system having a particular system pressure. Overpressurization or underpressurization of the piston chamber relative to the hydraulic system has been identified as a source of noise in piston pumps. An overpressurized piston chamber produces a pressure "overshoot" upon opening to the outlet, producing an audible noise. Such noise can increase as the pressure difference between the piston chamber and the outlet increases. Piston chamber underpressurization may produce noise because the rate of pressure change within the piston chamber is abrupt, and the higher system pressure impacts into the piston chamber. Ideal system operation occurs at conditions where the chamber pressure is equal to system pressure such that the pressure overshoot is zero and the rate of pressure change within the piston chamber is low.

Conventional methods to reduce piston pump noise have been somewhat ineffectual. Some existing methods suggest changing the port plate timing in such hydraulic piston pumps in order to lower the noise emanating from its use. However, such proposals are not feasible in that loads placed on port plates during operation are usually extremely high. Such high loads make it nearly impossible to move or adjust the port plates during operation.

Other techniques have also been proposed. In one example, an axial piston pump includes relief grooves that gradually transition the pressure as a barrel port rotates to the open port plate port. Another approach utilizes solenoids to open and close auxiliary ports formed in the port plate. However, none of these approaches have resulted in effectively eliminating noise arising from such piston pumps.

As a result, it is desirable to provide, among other things, an improved piston pump.

SUMMARY OF THE DISCLOSURE

In accordance with one embodiment, the present disclosure is directed to a piston pump. This piston pump may include a housing, a cylinder barrel, a plurality of pistons, an intake cam ring, an exhaust cam ring, a plurality of intake valves and a plurality of exhaust valves. The cylinder barrel is positioned within the housing and adapted to rotate about an axis of rotation by a drive shaft. The plurality of pistons may be arranged in the cylinder barrel. Each piston is configured to reciprocate within the cylinder barrel in a direction parallel to the axis of rotation of the cylinder barrel. The intake cam ring may be disposed in a first rotating path of each of the plurality of intake valves. The exhaust cam ring may be disposed in a second rotating path of each of the plurality of exhaust valves. The plurality of intake valves open and close relative to a clock position of the intake cam ring to regulate fluid supplied to each piston. Further, the plurality of exhaust valves open and close relative to a clock position of the exhaust cam ring to regulate fluid discharged by each piston.

In another embodiment, the present disclosure is directed to a method of controlling a piston pump. The method includes actuating a plurality of pistons housed within a cylinder barrel to cause each of the plurality of pistons to engage in reciprocating motion. Fluid supplied to each of the pistons is regulated by changing clock position of an intake cam ring to cause a plurality of intake valves to open and close relative to the clock position of the intake cam ring. Fluid discharged by each of the pistons is regulated by changing a clock position of an exhaust cam ring to cause a plurality of exhaust valves to open and close relative to the clock position of the exhaust cam ring.

In another embodiment, the present disclosure is directed to a piston pump assembly. The piston pump assembly includes a housing, a cylinder barrel, a plurality of pistons, an intake cam ring, an exhaust cam ring, a plurality of intake valves and a plurality of exhaust valves. The cylinder barrel is positioned within the housing and adapted to rotate about an axis by a drive shaft. The plurality of pistons may be arranged in the cylinder barrel. Each piston is configured to reciprocate within the cylinder barrel in a direction parallel to the axis of rotation of the cylinder barrel. The inlet port supplies fluid to each of the plurality of pistons. The outlet port receives fluid discharged by each of the plurality of pistons. The plurality of intake valves is arranged relative to the axis of rotation of the cylinder barrel. The intake cam ring may be disposed in a first rotating path of each of the plurality of intake valves. Also, the plurality of exhaust valves is arranged relative to the axis of rotation of the cylinder barrel. The exhaust cam ring may be disposed in a second rotating path of each of the plurality of exhaust valves. The plurality of intake valves open and close relative to a clock position of the intake cam ring to regulate fluid supplied to each piston. Further, the plurality of exhaust valves open and close relative to a clock position of the exhaust cam ring to regulate fluid discharged by each piston.

DETAILED DESCRIPTION

Reference will now be made in detail to exemplary embodiments, which are illustrated in the accompanying drawings. Wherever possible, the same reference numbers will be used throughout the drawings to refer to the same or like parts.

Figure 1:
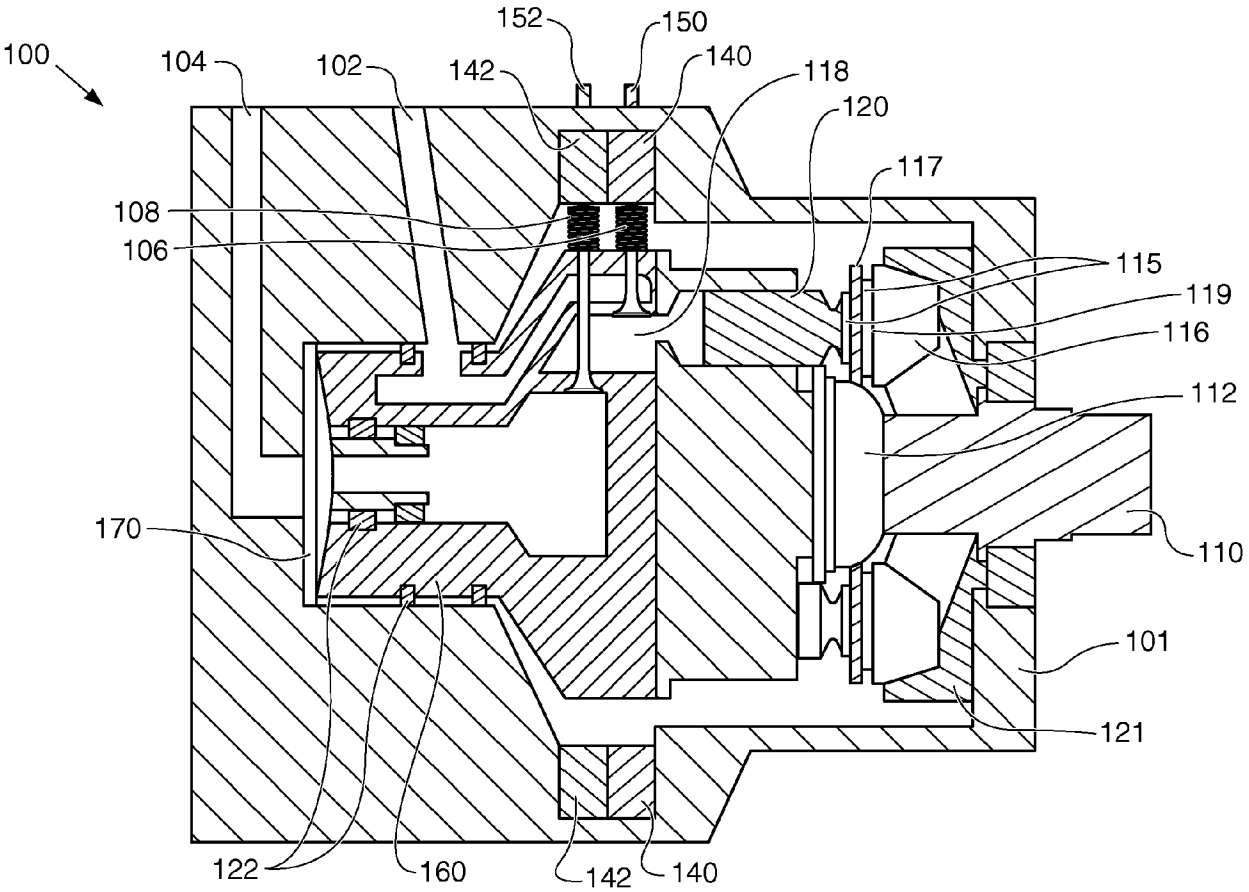
FIG. 1 illustrates a cross-sectional view of a piston pump according to one embodiment.

FIG. 1 illustrates a cross-sectional view of a piston pump according to one embodiment. The piston pump 100 may include a housing 101, drive shaft 110, cylinder barrel 114, and a plurality of pistons 120. The cylinder barrel 114 is positioned within the housing 101 and adapted to rotate about an axis of rotation by a drive shaft 110. The drive shaft 110 can be rotatably supported in the housing 101, and extends from and is integral with the cylinder barrel 114. The plurality of pistons 120 may be arranged in the cylinder barrel 114. In an embodiment, there may be a number of pistons such as 5, 7, 9 etc. Each piston 120 can be configured to reciprocate within the cylinder barrel 114 in a direction parallel to the axis of rotation of the cylinder barrel 114.

The piston pump 100 may also include a plurality of intake valves 106, a plurality of exhaust valves 108, an intake cam ring 140, and an exhaust cam ring 142. The intake cam ring 140 may be disposed in a first rotating path of each of the plurality of intake valves 106. The exhaust cam ring 142 may be disposed in a second rotating path of each of the plurality of exhaust valves 108. The plurality of intake valves 106 can open and close relative to a position of the intake cam ring 140 to regulate fluid received by each piston 120. Also, the plurality of exhaust valves 108 can open and close relative to a position of the exhaust cam ring 142 to regulate a discharge of fluid by each piston 120.

In one example, the piston pump 100 may further include an intake cam ring actuation arm 150, an exhaust cam ring actuation arm 152, an inlet port 102, and an outlet port 104. The intake cam ring actuation arm 150 can be actuated to control the clock position of the intake cam ring 140 along the first rotating path based on a first controlled timing. Also, the exhaust cam ring actuation arm 152 can be actuated to control the clock position of the exhaust cam ring 142 along the second rotating path based on a second controlled timing. The intake cam ring actuation arm 150 and the exhaust cam ring actuation arm can be operated by a source of energy that may be in the form of an electric current, hydraulic fluid pressure or pneumatic pressure, and which converts that energy into motion. In another example, the inlet port 102 is configured to be in fluid communication with the plurality of intake valves 106. The inlet port 102 may serve as a passage to supply a flow of the fluid to be regulated by the plurality of intake valves 106. An outlet port 104 may be in fluid communication with the plurality of exhaust valves 108. The outlet port 104 may serve as a passage to receive a flow of the discharged fluid regulated by the plurality of exhaust valves 108.

In an embodiment, the plurality of pistons 120 may be arranged in a circular array within the cylinder barrel 114. Each piston 120 may be disposed to receive fluid. Such fluid can be, for example, hydraulic fluid or the like that is compatible with the machine or engine. Each of the plurality of pistons 120 may be mounted in a cylinder barrel 114 which can be rotated by the drive shaft 110 that may be driven by an actuator, power source or motor. During operation, as the cylinder barrel 114 rotates, the pistons 120 are alternately stroked in and out by a swashplate 116, which may be inclined at a particular angle at full stroke. As the cylinder barrel 114 is rotated, the piston 120 retracts, expanding the pumping chamber 118. Fluid is drawn in to the pumping chamber 118 from the inlet port 102 when the intake valve 106 opens. The pistons 120 reach their maximum extent at bottom dead center (BDC), after which the pistons 120 extend, collapsing the pumping chamber 118 and thereby discharging the fluid through the exhaust valve 108 into the outlet port 104.

The piston pump 100 also includes a swashplate 116, fixedly disposed within a swashplate housing 121. The swashplate 116 is capable of changing its angular position to induce reciprocating motion on the plurality of pistons 120. As used herein, a swashplate is a device used to translate motion of the drive shaft 110 into reciprocating motion of the plurality of pistons 120. The swashplate housing 121 may be cast with the housing 101. The swashplate 116 may include a retraction plate 117, a plurality of slippers 115, and a swashplate face 119 that are associated with each piston 120. The head of each piston 120 is attached to the retraction plate 117 via slippers 115. Slippers 115 can have a coat of oil that provides lubrication at the contacting surface of the swashplate 116. The retraction plate 117 rests on the backside of the plurality of slippers 115. As the drive shaft 110 rotates, each piston 120 takes a reciprocating motion from points on the swashplate 116, which provides reciprocating motion to each piston 120. The refraction plate 117 holds the plurality of slippers 115 against the swashplate surface 119.

The piston pump 100 may further include a cylinder head 160 and lens plate 170. The cylinder head 160 provides a housing for a flow path that connects the plurality of pumping chambers 118 to the inlet port 102 and the outlet port 104. The cylinder head also provides a rigid body for the plurality of intake valves 106 plurality of exhaust valves 108 to reside in. The lens plate 170 provides a sealing surface between the housing 101 and cylinder head 160. Sealing rings 122 and bearings can be provided at various junctions where there is relative motion between the component parts, or where there is fluid flow at a junction so as to prevent any leaks from occurring.

Figure 2:
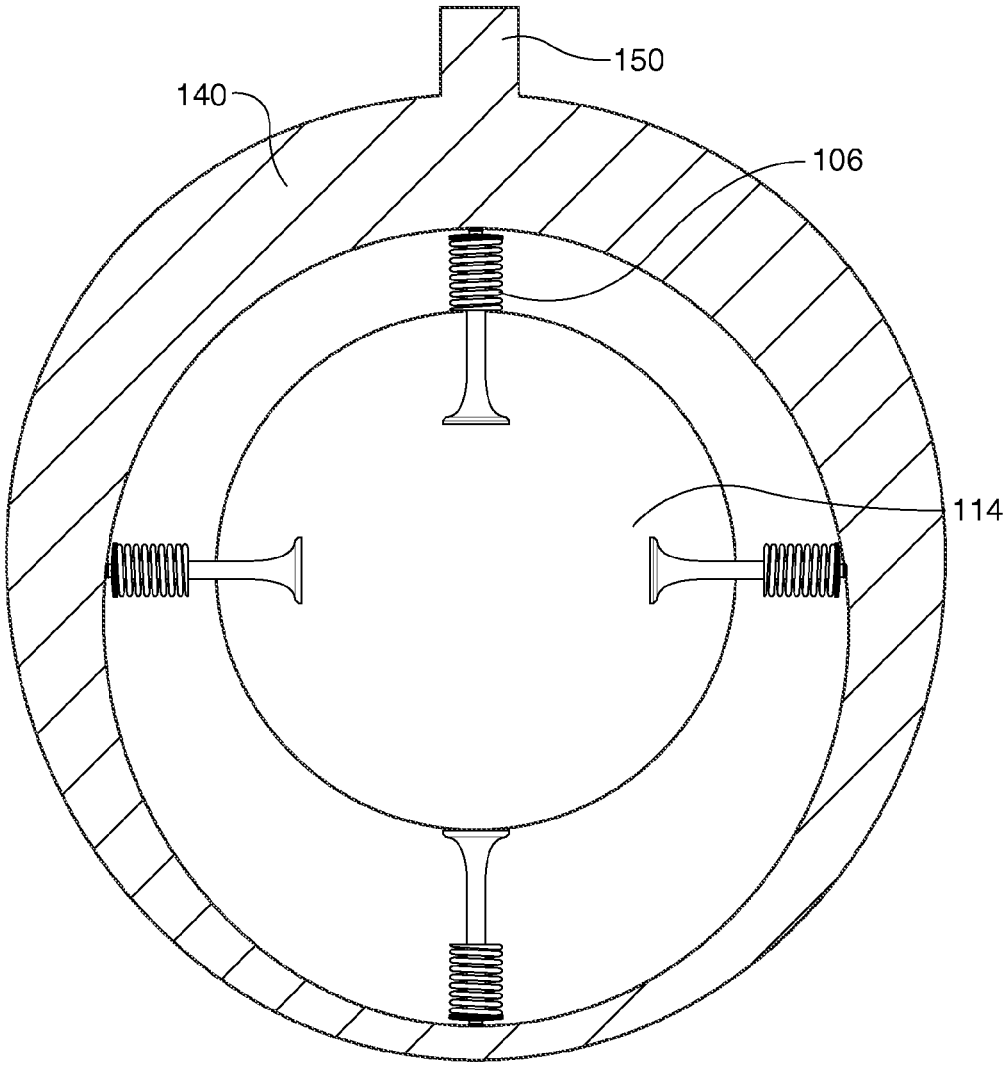
FIG. 2 illustrates a cross-sectional view of an intake cam ring relative to the intake valves according to one embodiment.

FIG. 2 illustrates a cross-sectional view of an intake cam ring relative to the intake valves according to one embodiment. The intake cam ring 140 can be configured as a moveable device used to transform rotary motion of the cylinder barrel 114 into reciprocating motion of the plurality of intake valves 106. The intake cam ring 140 may be part of a moveable wheel such as an internal eccentric or internal elliptical wheel that opens each of the intake valves 106 at a determined period of their rotary path. The intake cam ring 140 can be configured in other forms such as a sliding piece or as a shaft (e.g. a cylinder with an irregular shape) that can transform rotary motion into linear motion or vice-versa. The intake cam ring 140 can be connected to an intake cam ring actuation arm 150. The intake cam ring actuation arm 150 can be connected to an actuator, a motor, or electronic device. Such an actuator, motor or electronic device can serve as a control device to cause a change in clock position of the intake cam ring 140. For example, the intake cam ring 140 receives actuation forces via the intake cam ring actuation arm 150 to control the intake cam ring 140 clock positions. Such clock positions may be adjusted to a desired timing to control the opening and closing of each intake valve 106. The ability to control the position or timing of the intake cam ring 140 helps to regulate fluid received by each piston 120.

As such, each of the rotating intake valves 106 can be arranged in the path of the intake cam ring 140. The thickest part of the intake cam ring 140 causes the most displacement of the intake valves 106, thereby causing the most fluid to be supplied to the pistons 120 at this position. There is no displacement of the intake valves 106 at the thinnest part of the rotating intake cam ring 140. The intake valves can be disposed in a closed position at the thinnest part of the intake cam ring 140. Thus, the intake cam ring 140 serves to control the supply of fluid to the pistons 120 by regulating the opening and closing of the intake valves 106.

Figure 3:
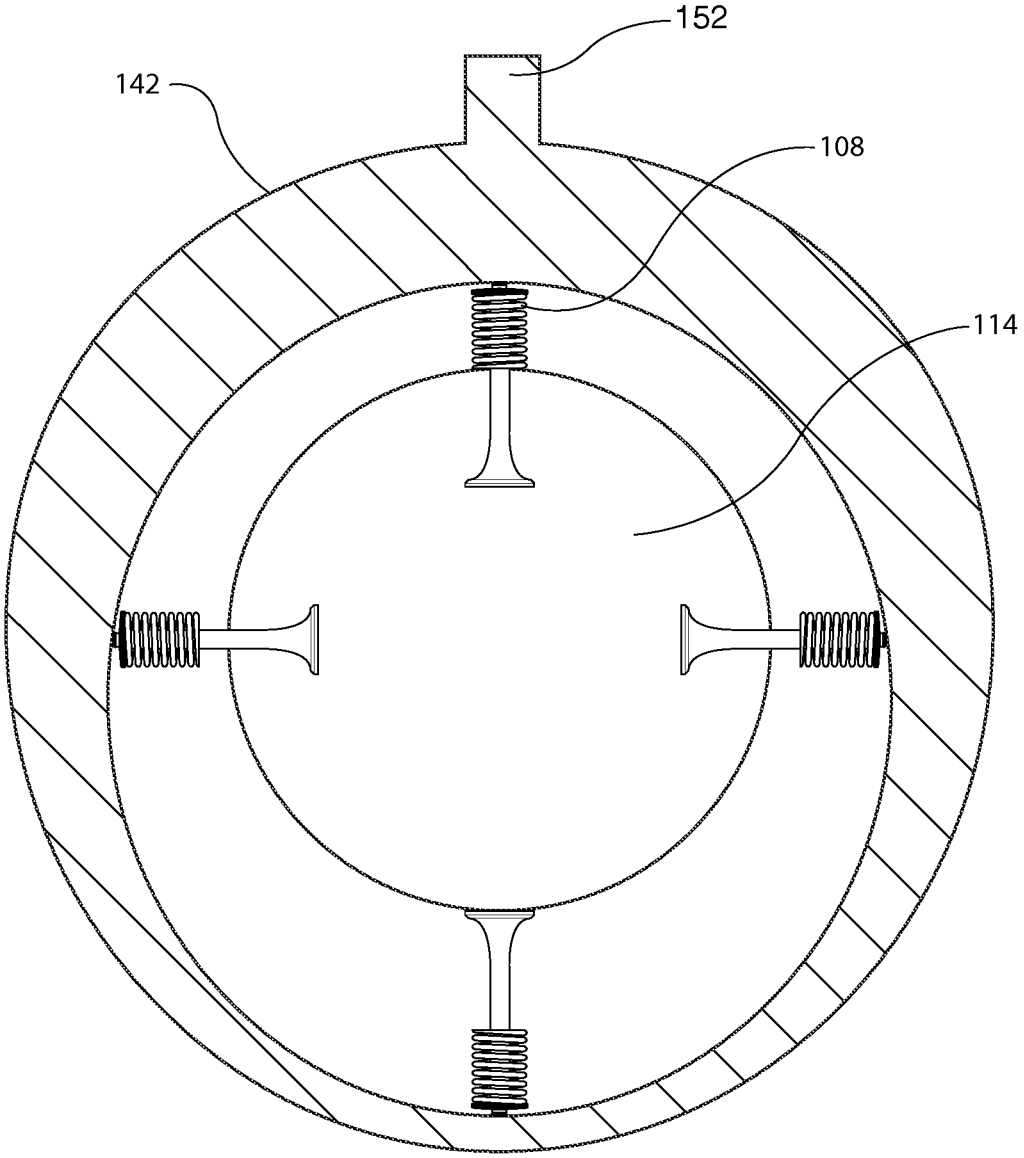
FIG. 3 illustrates a cross-sectional view of an exhaust cam ring relative to the exhaust valves according to one embodiment.

FIG. 3 illustrates a cross-sectional view of an exhaust cam ring relative to the exhaust valves according to one embodiment. The operation of the exhaust cam ring 142 is somewhat similar to that of the intake cam ring 140. For example, the exhaust cam ring 142 can be configured as a moveable device used to transform rotary motion of the cylinder barrel 114 into reciprocating motion of the plurality of exhaust valves 108. The exhaust cam ring 142 may be part of a moveable wheel such as an internal eccentric or internal elliptical wheel that opens each of the exhaust valves 108 at a determined period in their rotary path. The exhaust cam ring 142 can be configured in other forms such as a sliding piece or as a shaft (e.g. a cylinder with an irregular shape) that can transform rotary motion into linear motion or vice-versa. The exhaust cam ring 142 can be connected to an exhaust cam ring actuation arm 152. The exhaust cam ring actuation arm 152 can be connected to an actuator, a motor, or electronic device. Such an actuator, motor or electronic device can serve as a control device to cause a change in clock position of the exhaust cam ring 142. For example, the exhaust cam ring 142 receives actuation forces via the exhaust cam ring actuation arm 152 to control the exhaust cam ring 142 clock positions. Such clock positions may be adjusted to a desired timing to control the opening and closing of each exhaust valve 108. The ability to control the position or timing of the exhaust cam ring 142 helps to regulate fluid discharged by each piston 120.

Further, each of the rotating exhaust valves 108 can be arranged in path of the exhaust cam ring 142. The thickest part of the exhaust cam ring 142 causes the most displacement of the exhaust valves 108, thereby causing the most oil discharged by respective pistons 120 at this position. There is no displacement of the exhaust valves 108 at the thinnest part of the rotating exhaust cam ring 142. The exhaust valves 108 can be disposed in a closed position at the thinnest part of the exhaust cam ring 142. Thus, the exhaust cam ring 142 serves to control a flow of the fluid discharged by the pistons 120 by regulating the opening and closing of the exhaust valves 108.

In an exemplary operation of the piston pump 100, the connection between the pumping chamber 118 associated with each piston 120 and the outlet port 104 is open when each piston 120 is at the top of the reciprocation cycle (TDC). In this position, for example, the exhaust valve 108 is disposed at the thickest position of the exhaust cam ring 142. On the other hand, the intake valve 106 associated with the respective piston 120 is disposed at the thinnest portion of the intake cam ring 140. As the cylinder barrel 114 rotates, each intake valve 106 opens and closes based on the position of each intake valve 106 relative to the intake cam ring 140. (FIG. 2). The opening of each intake valve 106 causes fluid, via the inlet port 102, to fill the pumping chamber 118. Fluid is then supplied to each piston 120 as it rotates in the rotating path of the intake cam ring 140.

Further, as each piston 120 orbits about the cylinder barrel 114 axis, it moves away from the cylinder head 160, thereby increasing the volume of fluid in the pumping chamber 118. As this occurs, fluid enters the pumping chamber 118 from the inlet port 102 to fill the void. This process continues until the piston reaches the bottom of the reciprocation cycle (BDC). At BDC, the intake valve 106 is in a closed position causing the connection between the pumping chamber 118 and inlet port to be closed. In this position, for example, the exhaust valve 108 is disposed at the thickest portion of the exhaust cam ring 142. The pumping chamber 118 now becomes open to the outlet port 104 to allow discharge of the fluid. The pumping cycle can then start over again.

INDUSTRIAL APPLICABILITY

The disclosed piston pump 100 may be applicable to any machine or hydraulic system that requires regulating oil supplied to and/or discharged by a plurality of pistons. As one example, the piston pump 100 may be a component of a hydrostatic drive system. The operation of the piston pump will now be explained in connection with the flowchart of FIG. 4.

Figure 4:
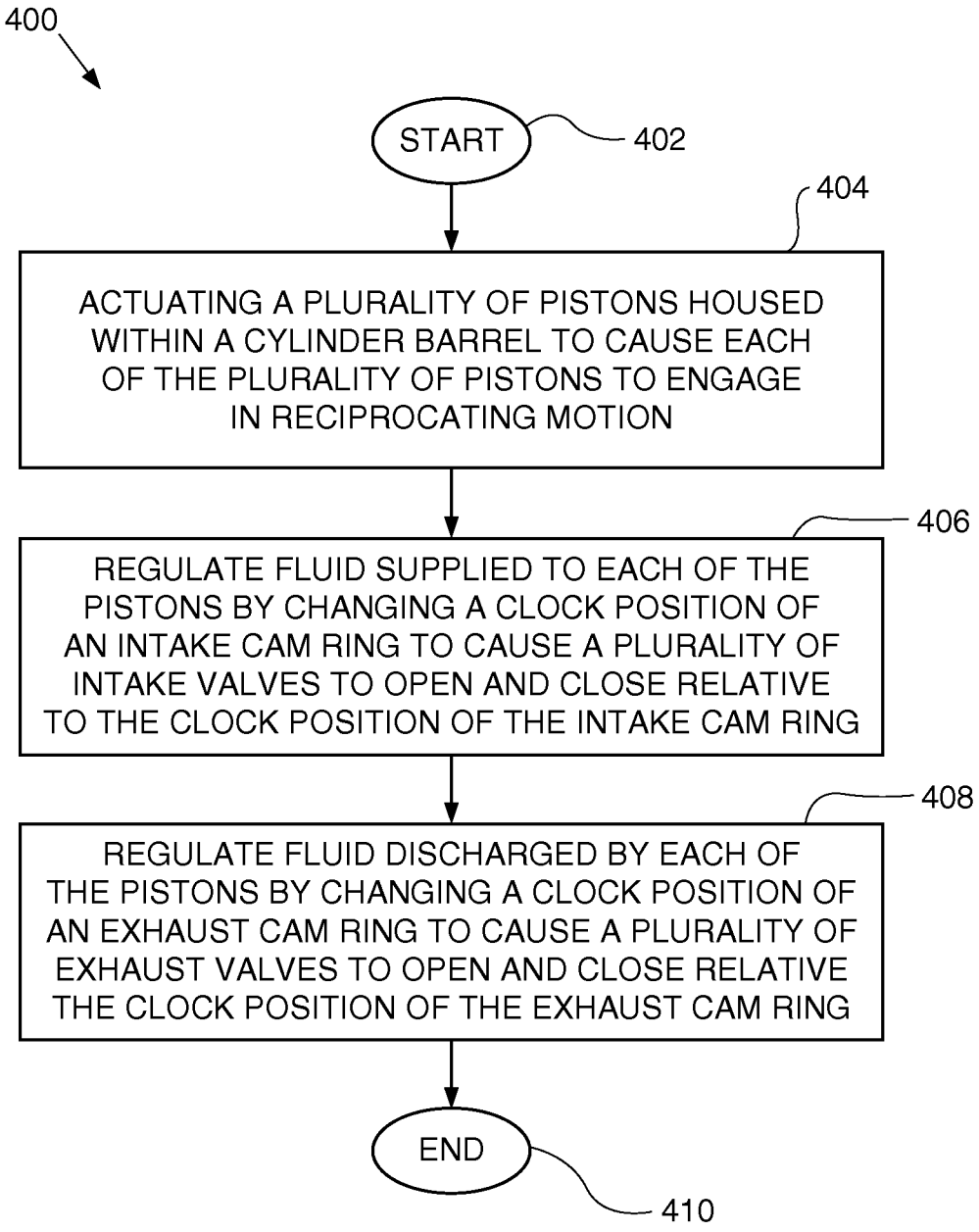
FIG. 4 illustrates, in flow-chart form, a method for controlling a piston pump according to one embodiment.

FIG. 4 illustrates in flow-chart form a method for controlling a piston pump according to one embodiment. The method starts in operation 402. In operation 404, a plurality of pistons 120 housed within a cylinder barrel 114 may be actuated to cause each of the plurality of pistons 120 to engage in reciprocating motion. Such reciprocating motion may be caused via the orbiting of the pistons 120 about the drive shaft 110 axis of rotation and the action of such movement against the swashplate face 119. As such, each piston may reciprocate within the housing and in a direction parallel to the axis of rotation of the cylinder barrel.

In operation 406, fluid supplied to each piston 120 may be regulated. An intake cam ring 140 may be disposed in a rotating path of each of the intake valves 106. Clock positions of the intake cam ring 140 can cause the plurality of intake valves 106 to open and close at determined periods in their rotary path relative to a position of the intake cam ring 140. This results in the supplied fluid being regulated by the intake valves 106. The fluid to be regulated by the intake valves 106 may be supplied via an inlet port 102. The plurality of intake valves 106 may be arranged relative to the axis of rotation of the cylinder barrel 114. This facilitates the fluid regulation by the intake valves 106.

In operation 408, fluid discharged by each piston 120 is regulated. An exhaust cam ring 142 may be disposed in a rotating path of each of the exhaust valves 108. Clock positions of the exhaust cam ring 142 can cause the plurality of exhaust valves 108 to open and close at determined periods in their rotary path relative to a position of the exhaust cam ring 142. An outlet port 104 may receive fluid discharged by each piston 120. The plurality of exhaust valves 108 may be arranged relative to the axis of rotation of the cylinder barrel 114. This facilitates the fluid regulation by the exhaust valves 108. The process ends in operation 410. It will be recognized that these operations may be performed in any suitable order.

The piston pump 100 reduces or eliminates noise that can arise during the supply of fluid to the pistons 120 and the discharge of fluid by the pistons 120. For example, the intake valves 106 and exhaust valves 108 can be arranged perpendicular to the axis of the rotating cylinder barrel 114 to facilitate the opening and closing of the valves. The clock positions, for example, of the intake cam ring 140 and the exhaust cam ring 142 can also be changed during operation of the piston pump 100. This provides an operator with an ability to independently control or adjust the intake valve timing and exhaust valve timing of the piston pump. As such, optimal timings at different pressures, displacements and rpm (revolutions per minute) of the barrel can be achieved.

While this disclosure includes particular examples, it is to be understood that the disclosure is not so limited. Numerous modifications, changes, variations, substitutions and equivalents will occur to those skilled in the art without departing from the spirit and scope of the present disclosure upon a study of the drawings, the specification and the following claims.

What is claimed is:

1. A method of controlling a piston pump, comprising:

actuating a plurality of pistons housed within a cylinder barrel to cause each of the plurality of pistons to engage in reciprocating motion;

regulating fluid supplied to each of the pistons by changing a clock position of an intake cam ring to cause a plurality of intake valves to open and close relative to the clock position of the intake cam ring, wherein the intake cam ring surrounds the plurality of intake valves; and regulating fluid discharged by each of the pistons by changing a clock position of an exhaust cam ring to cause a plurality of exhaust valves to open and close relative to the clock position of the exhaust cam ring, wherein the exhaust cam ring surrounds the plurality of exhaust valves.

2. The method of claim 1, further comprising:

controlling, via an intake cam ring actuator arm, the intake cam ring clock position along a first rotating path based on a first controlled timing.

3. The method of claim 2, wherein the intake cam ring receives actuation forces via the intake cam ring actuator arm to control the intake cam ring clock position.

4. The method of claim 2, further comprising:

controlling, via an exhaust cam ring actuation arm, the exhaust cam ring clock position along a second rotating path based on a second controlled timing.

5. The method of claim 4, wherein the exhaust cam ring receives actuation forces via the exhaust cam ring actuator arm to control the exhaust cam ring clock position.

6. The method of claim 1, further comprising:

supplying, via an inlet port, the fluid regulated by the plurality of intake valves; and receiving, via an outlet port, the discharged fluid regulated by the plurality of exhaust valves.

7. The method of claim 1, wherein the reciprocating motion is generated by actions from rotations of the cylinder barrel housing the plurality of pistons which are orbiting and which act against a swashplate, the swashplate configured to translate the cylinder barrel rotations into reciprocating motion of the plurality of pistons.

* * * * *